United States Patent [19]

Burgess et al.

[11] Patent Number: 4,593,436

[45] Date of Patent: Jun. 10, 1986

[54] BAFFLED WEBFORMER AND SYSTEM

[75] Inventors: W. D. Burgess, Dallas; Glenn E. Lytton; Ronald S. Nash, both of Gastonia, all of N.C.

[73] Assignee: Fiber Controls Corporation, Gastonia, N.C.

[21] Appl. No.: 773,092

[22] Filed: Sep. 4, 1985

Related U.S. Application Data

[63] Continuation of Ser. No. 106,359, Dec. 21, 1979, abandoned.

[51] Int. Cl.[4] ..... D01G 15/40

[52] U.S. Cl. ..... 19/105; 19/296; 19/300

[58] Field of Search ..... 19/105, 296, 300

[56] References Cited

U.S. PATENT DOCUMENTS

| | | | |
|---|---|---|---|
| 3,169,664 | 2/1965 | Meinicke | 19/105 X |
| 4,240,180 | 12/1980 | Wood et al. | 19/105 |
| 4,280,251 | 7/1981 | Ludwig | 19/105 |
| 4,394,790 | 7/1983 | Keller et al. | 19/105 |
| 4,404,710 | 9/1983 | Wood | 19/105 |
| 4,449,272 | 5/1984 | Cash | 19/105 |

FOREIGN PATENT DOCUMENTS

| | | | |
|---|---|---|---|
| 1007772 | 10/1965 | United Kingdom | 19/105 |

*Primary Examiner*—Louis K. Rimrodt

*Attorney, Agent, or Firm*—Cushman, Darby & Cushman

[57] ABSTRACT

In a webformer including a chute for feeding a web of fibers to subsequent equipment the improvement comprising an air deflector plate for controlling the amount of air that can be exuded from substantially all areas of a perforated wall.

5 Claims, 2 Drawing Figures

BAFFLED WEBFORMER AND SYSTEM

This is a continuation, of application Ser. No. 106,359, filed Dec. 21, 1979, which was abandoned upon the filing hereof.

BRIEF DESCRIPTION, BACKGROUND AND SUMMARY OF THE INVENTION

The invention relates to an improved apparatus and system for feeding fibers to a carding machine or the like.

Devices for feeding a web of uniform density and thickness to a card are commonly referred to as webformers. In modern textile processing plants, fibers are delivered to the webformers, entrained in a stream of air. The air and entering fibers are separated from one another usually in the webformer. For example, see U.S. Pat. Nos. 3,750,235 to Wise, 4,009,803 and 4,154,485 to Lytton et al and 3,414,330 to Trutzschler, the background content of all of which is incorporated hereinto by reference. Webformers have been known to be equipped at their top with reserve chambers which connect to the underside of the common duct which delivers the air-entrained fibers. In such reserve chambers, there is one wall which has perforations, and in the past solid plates have been employed in abutment with the perforated walls of the reserve chambers to control the amount of air allowed to escape through those perforated walls. However, it has been discovered that such control is not sufficient for a complete system, but that such can only be controlled properly if the reserve chambers are equipped with baffle or air deflector plates which are or can be spaced from the perforated wall of the reserve chamber. Perferably, such deflector plates are adjustable from a position in abutment with the perforated wall of the reserve chamber whereby no air can be exuded through the hole thereof, to a position horizonatally removed therefrom. Furthermore, such air deflector plates are preferably pivotable about a horizontal axis so that the top and bottom thereof can be tilted toward and away from the perforated wall. Such an arrangement provides the advantages of being able to control each of the webforming reserve chambers more precisely to cause a greater uniformity in the amount of fibers stored therein and to prevent chokedowns therein. In the line between the first webformer in a series and the fan which blows the air entrained fibers down the line is a pressure sensor which senses when the air pressure in the line becomes too great because all of the reserve chambers are full of fibers, and operates to turn off the fiber supply. Consequently, the reserve chambers are not overfilled, nor are there any fibers which are transported beyond the last webformer in the series.

Many other objects and purposes of this invention will become clear from the following detailed description of the drawings, in which:

FIG. 1 illustrates a partial distributing system in accordance with this invention, and FIG. 2 illustrates partially diagrammatically, one station in accordance with this invention.

DETAILED DESCRIPTION OF THE DRAWINGS

Figure 1:
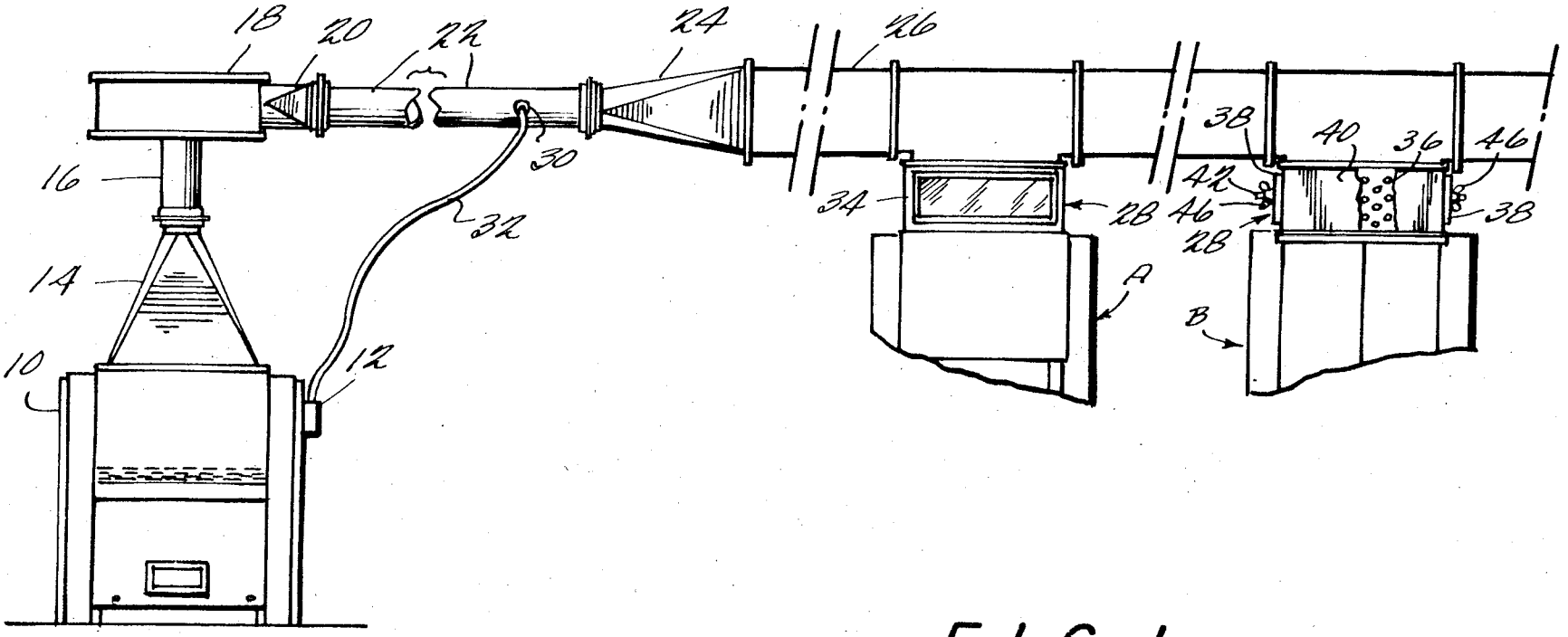

In FIG. 1, the system is shown as including a source of fiber 10 which has conventional feed rolls (not shown) operated by pressure switch 12 to feed fiber through transition 14 and duct 16 to the material handling fan 18.

Fan 18 is continuously operative to push air at high speed, for example from about 1200 CFM or less to 1600 CFM or less to 1600 CFM or more according to the number of stations down line that the system is to serve. This air is forced by fan 18 via transition 20, through duct 22 which preferably has a 10 inch diameter, on through transition 24 into a rectangular duct 26. This duct 26 is the primary duct serving the stations down line and preferably has a cross-sectional area which is approximately that of duct 22. In practice, with duct 22 having a diameter of 10 inches, it has been found that duct 26 is very suitable if its dimensions are 5 inches in width by 18 inches height. There is no exhaust fan or the like at the opposite end of duct 26, but instead just equipment for picking up dust since no fibers will remain in the line, as will become more apparent below. A conventional plenum chamber for example is employed at the end of the line.

Although FIG. 1 only shows two receiving stations A and B, any desired number of stations can be served by this system according to the amount of air being thrust down the main duct 26 by fan 18. For example if the fan moves the air at 1600 CFM, 10 or 12 stations may be served thereby. Fibers supplied by source 10 through fan 18 are moved along duct 26 with the air until the air and fibers are drawn downward into one of the stations. As is discussed in more detail below, when each of the reserve chambers 28 of all of the stations is full so as to block off the air passage therefrom into the atmosphere or collecting duct (not shown), the back pressure in duct 26 builds up sufficiently high (for example, 1.5 inches of water) so that the back pressure gauge 30 sends a signal over air line 32 to pressure switch 12 to cause its feed rollers to stop feeding fibers into fan 18, though the fan continues to run.

Figure 2:
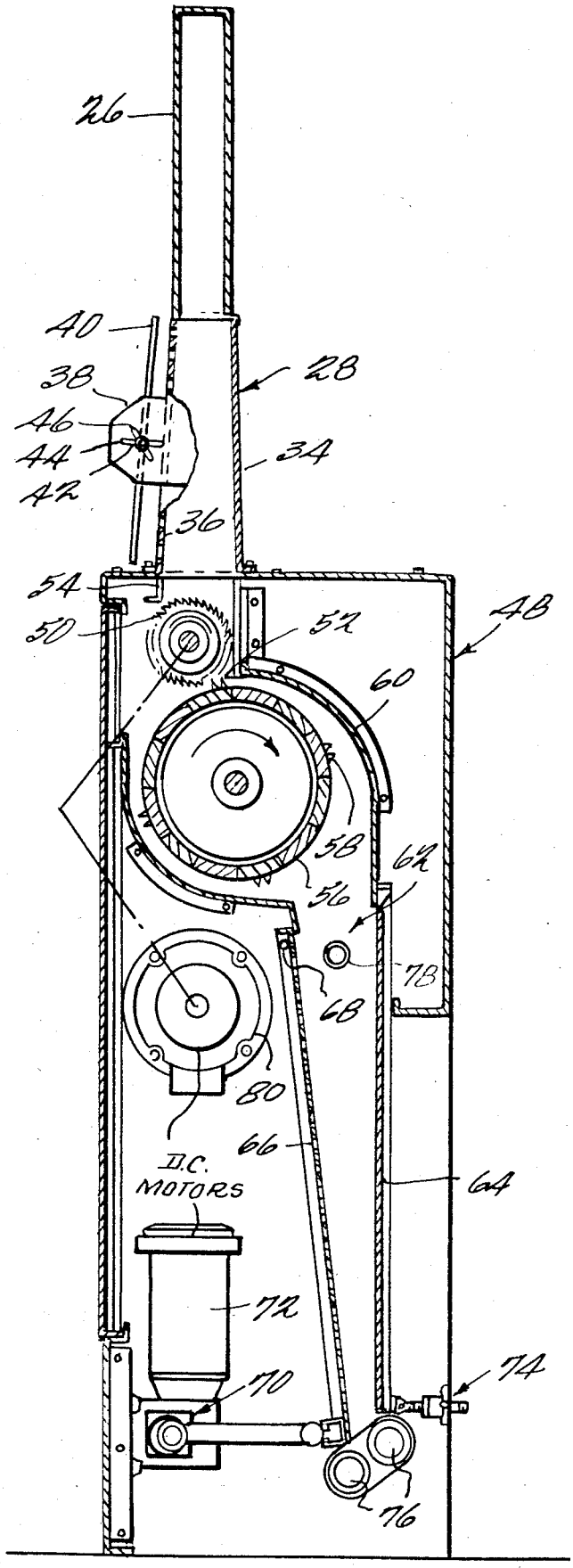

Each of the stations along line 26, for example stations A, B, etc., include webformers which are preferably constructed in accordance with the showing in FIG. 2. In FIG. 2, the right hand side of the equipment is the front, and reserve chamber 28 preferably has its full front side 34 made of glass, for example "plexiglass", except for a border as shown in FIG. 1 for the reserve chamber at station A. It will be noted that FIG. 1 shows the front view of station A, while the rear view of station B is illustrated in FIG. 1. While it is possible for the system to feed in either direction perpendicular to the plane of FIG. 1, normally a group of adjacent stations will all feed cards which are on the same side of duct 26. In any event, it should be observed that the rear view illustration of station B in FIG. 1 allows the showing of a face view of the perforated plate 36 which forms the back side of reserve chamber 28. This plate is preferably of hot roll steel, 14 gauge, with perforations (through-holes) which are preferably of ⅛ inch diameter on 3/16 inch staggered centers. These holes cover substantially the full width and height of the rear side 36. Reserve chamber 28 has, for example, a 21 inch height, with plate 36 being perforated for a height of 18 inches, i.e., with a border of 1.5 inches.

Fixed to opposite ends of these reserve chamber 28 is a pair of brackets 38 between which is mounted a baffle or air deflector plate 40. At each end of plate 40 is a threaded shaft 42 which extends through respective horizontal slots 44 in the plates 40, and each of the threaded shafts carries a wing nut 46 or the like for securing the baffle plate 40 in a desired position. Plate 40 is at least coextensive in height and width with the perforated back wall 36 of chamber 28, and in keeping with the present example, is at least 18 inches tall and 34 inches wide, but is solid and not perforated. It is preferably made of thin steel, for example 16 gauge, so that it can be manually bendable if necessary to help regulate the air flow through the perforated wall 36 as explained in more detail below.

Slots 44 in each of brackets 38 allow plate 40 to be moved from a position of complete abutment with perforated wall 36 so that no air can go therethrough, to a position where plate 40 is spaced at least at its center about 4 inches rearwardly away from perforated wall 36. At the same time, by virtue of the mounting of baffle plate 40, it is readily apparent that the plate can be tilted clockwise or counterclockwise about its horizontal central axis as defined by threaded shaft 42. It is apparent, therefore, that baffle plate 40 has considerable flexibility as to where it can be placed in order to control the air flow through the perforated back wall of chamber 28.

Reserve chamber 28 is set atop webformer 48, and together the webformer and reserve chamber form any one of the receiving stations fed by the distributing system, for example stations A and B of FIG. 1. Reserve chamber 28 preferably has a width the same as the width of the primary transmission duct 26, for example 5 inches, at its top, but as shown in FIG. 2 it has a wider bottom dimension, for example 6 inches, in order to feed fibers into the feed roll 50, which has a corresponding diameter, for example 6 inches. Feed roll 50 is preferably of the wire wound type, and is rotated clockwise in FIG. 2, so as to cooperate with, feed plate 52. Plate 54 helps guide fibers into feed plate 52. A 14 inch opening roll 56 with its spikes 58 rotates clockwise in FIG. 2 to catch the fibers as they are brought downward by feed roll 50 adjacent feed plate 52, and to move the fibers clockwise in the space between roll 56 and guide plate 60 down into the shaker chute 62. This chute is formed in a manner similar to either one of the chutes in prior U.S. Pat. Nos. 3,750,235, 4,009,803, or 4,154,485. For example, it preferably has a glass front 64 and a perforated shaker 66 constructed as in any of those prior patents, which is pivoted at its top on pivot 68 and moved forward and backward at its bottom by an eccentric mechanism 70 driven by a D.C. shaker drive motor 72. The glass front 64 may be adjusted by adjusting mechanism 74, and the fibers which are shaken into a web within chute 62 are delivered therefrom by conventional fluted delivery feed rolls 76, which may be controlled in conventional form by subsequent equipment such as a card (not shown).

Opening roll 56 is driven continuously by an A.C. motor (not shown) but feed roll 50 is driven only when chute 62 requires more fibers. This is determined by a level control 78, preferably of the ultra-sonic type, which when it senses that the horizontal sonic beam or the like is not covered by fibers, causes D.C. motor 80 to drive feed roll 50. Conversely, when chute 62 is sufficiently filled with fibers so as to cover level control 78, motor 80 is turned off and feed roll 50 stops feeding fibers from reserve chamber 28 into opening roll 56.

Whenever fibers are transmitted through the primary duct 26, they will be drawn into the first reserve chamber 28 which is not full, i.e., in which fibers do not cover all of the perforations in back wall 36 which are themselves not covered by the baffle plate 40. That is, if the baffle plate is spaced away from wall 36, then the perforations therein pass the air which is under pressure, while the entrained fibers are stopped by wall 36 and fill chamber 28 as well as the area just immediately above feed roll 50. If this roll is not operating, i.e., if the shaker chute 62 is full, then the fibers that come into chamber 28 will just continually tend to fill up that chamber. Of course, as feed roll 50 rotates and pulls more fibers down from chamber 28, more holes in plate 36 open up, giving the air a chance to be drawn from duct 26 through those opened holes, so that more fibers fall into chamber 28. This, of course, tends to keep chamber 28 full, depending upon the demand of fibers by the shaker chute 62, which in turn depends upon the demand of fibers by the card or the like being fed by feed roll 76.

Whenever a chamber 28 is full, fibers are transported by the air duct 26 to the next receiving station in which requires more fibers to fill its chamber 28. This is effected all the way down the line, and whenever all of the reserve chambers 28 are full so that no air can pass through any of the apertures in the back walls 36 of the receiving stations, the pressure in duct 26 builds up considerably. This is sensed by sensor 30 in FIG. 1, causing an air signal in line 32 to cut off switch 12 and stop the feeding of fibers from source 10 to fan 18. In this regard, the system has some similarity to the Trutzschler U.S. Pat. No. 3,414,330.

If the baffle or air deflector plates 40 of the receiving stations A, B, etc., along duct 26 are not properly positioned relative to the perforated walls 36 of their respective reserve chamber 28, fibers may not fill some portions of those chambers. Hence, each of the air deflector or baffle plates 40 may be adjusted inwardly and outwardly and/or at an angle to the vertical in either direction so as to control the amount of air that can come through the apertures in the respective back wall 36. Adjustment of baffle plate 40 regulates the amount of back pressure to help reduce choke-downs in the respective reserve chamber 28. If a corner of the chamber is not receiving enough fibers, or too many fibers, the corresponding corner of plate 40 can be manually bent to overcome the problem. Preferably, each of plates 40 has a 1 inch break (right angle) edge all around its periphery to provide greater strength to the plates, but this does not prevent them from being manually bent since they are made of 16 gauge material.

It should be realized that at each station along the line, the respective baffle plate 40 may be at a different position, with even the first one or so in the line operating to close off all of the air holes in wall 36 for that station Other stations along the line will have their plates 40 adjusted during installation of the system so as to cause all of the receiving stations to receive their full allotment of fibers as called for by the cards or other equipment being fed from shaker chutes 62.

Many changes and modifications in the above described equipment of this invention can, of course, be carried out without department from the scope of this invention as defined by the appended claims.

We claim:

1. A webformer for removing fibers from a duct carrying a stream of air with textile fibers entrained therein and forming a web of said fibers, comprising:

means including a chute for feeding said web to subsequent equipment, means for feeding fibers into said chute as required by the chute, reserve chamber means for receiving fibers at an upper level from said conduit and presenting them at a lower level to said feeding means, said reserve chamber means having substantially air tight vertical walls except for one wall having a substantial area which is substantially perforated with a multiplicity of spaced holes that will exude air but not said fibers whereby fibers received with exuded air will drop downward in said reserve chamber means toward said feeding means, and an air deflector plate having a solid area coextensive with said perforated wall area and spaced therefrom for controlling the amount of air that can be exuded from substantially all areas of said perforated wall.

2. A webformer as in claim 1 wherein said deflector plate is manually bendable and/or adjustable toward and away from said wall and/or in vertical angle clockwise and/or counterclockwise relative to said wall.

3. A textile fiber distributing system comprising a series of webformers as in claims 1 or 2 and including said duct for feeding said webformers, means for supplying air entrained fibers to said duct under air pressure, means for sensing the air pressure in said duct between the first webformer in said series and said supplying means for turning the supply of fibers off when the pressure in said line exceeds a predetermined amount as caused by fibers blocking all of said holes in each reserve chamber means of all of said webformers in said series.

4. A distributing system for delivering textile fibers to a plurality of textile machines comprising:

a duct, means for supplying a stream of air with textile fibers entrained therein to said duct with air under positive pressure, a series of webformers having respective reserve chambers connected at spaced points along said duct to receive fibers therefrom, said web formers being operable to extract fibers from their respective reserve chambers for forming a web and feeding same to the respective textile machines, each said reserve chamber having a substantial vertical wall area which is substantially perforated with a multiplicity of spaced holes that will exude air but not said fibers whereby fibers received with air exuded through said holes will drop downward in said reserve chamber toward the respective webformer, each said reserve chamber further having an air deflector plate having a solid area coextensive with said perforated wall area before controlling the amount of air that can be exuded from substantially all areas of that perforated wall, at least one of said deflector plates being spaced from the corresponding perforated wall, and means for sensing the air pressure in said duct between the first webformer in said series and said supplying means for turning the supply of fibers off when the pressure in said duct exceeds a predetermined amount as caused by fibers blocking all of said holes in each reserve chamber of all of the webformers in said series.

5. A webformer as in claim 4 wherein each of said deflector plates is manually bendable and/or adjustable toward and away from said wall and/or in vertical angle clockwise and/or counterclockwise relative to said wall.

* * * * *